US009325072B2

(12) United States Patent
Oh et al.

(10) Patent No.: US 9,325,072 B2
(45) Date of Patent: Apr. 26, 2016

(54) TOUCH SCREEN PANEL ANTENNA OF MOBILE TERMINAL

(75) Inventors: Kyung Jin Oh, Hwaseong-si (KR); Oh Hyuck Kwon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1197 days.

(21) Appl. No.: 12/977,620

(22) Filed: Dec. 23, 2010

(65) Prior Publication Data

US 2011/0156967 A1 Jun. 30, 2011

(30) Foreign Application Priority Data

Dec. 28, 2009 (KR) ..... 10-2009-0131636

(51) Int. Cl.
*H01Q 1/24* (2006.01)
*H01Q 9/40* (2006.01)
*H01Q 9/42* (2006.01)

(52) U.S. Cl.
CPC ... *H01Q 9/40* (2013.01); *H01Q 9/42* (2013.01)

(58) Field of Classification Search
CPC ..... H01Q 1/38
USPC ..... 343/702
See application file for complete search history.

(56) References Cited

U.S. PATENT DOCUMENTS 6,661,408 B2 * 12/2003 Chen ..... 345/173
8,279,188 B2 10/2012 Kusuda et al.

FOREIGN PATENT DOCUMENTS

KR 10-2007-0016731 A 2/2007
KR 10-2009-0107025 A 10/2009

* cited by examiner

*Primary Examiner* — Graham Smith
(74) *Attorney, Agent, or Firm* — Jefferson IP Law, LLP

(57) ABSTRACT

A touch screen panel (TSP) antenna of a mobile terminal is provided. The TSP antenna includes an ITO film stacked in a TSP, an upper electrode line, a lower electrode line, a left electrode line, and a right electrode line formed at an upper or lower surface of the ITO film, an external surface, and an antenna pattern formed in at least one of an upper surface, a lower surface, a left surface, and a right surface of the external surface.

11 Claims, 6 Drawing Sheets

TOUCH SCREEN PANEL ANTENNA OF MOBILE TERMINAL

PRIORITY

This application claims the benefit under 35 U.S.C. §119 (a) of a Korean patent application filed on Dec. 28, 2009 in the Korean Intellectual Property Office and assigned Serial No. 10-2009-0131636, the entire disclosure of which is hereby incorporated by reference.

BACKGROUND OF THE INVENTION

1. Field of the Invention

The present invention relates to a Touch Screen Panel (TSP) antenna of a mobile terminal. More particularly, the present invention relates to a TSP antenna of a mobile terminal in which an antenna pattern is formed an upper surface or a lower surface of an Indium Tin Oxide (ITO) film.

2. Description of the Related Art

Examples of antennas used for mobile terminals include external antennas and internal antennas. In recent years, internal antennas are widely used due to the reduced impact on the outer appearance of mobile terminals. Carrier antennas and Printed Circuit Board (PCB) antennas are examples of internal antennas. In carrier antennas, an antenna pattern is formed at a carrier adhered to a main circuit board. In PCB antennas, an antenna pattern is directly formed on a main circuit board.

However, since the carrier has a minimum thickness of 5 mm, materials costs for carrier antennas are high. In addition, as carrier antennas have a large volume, space utilization is low. The materials cost and volume of PCB antennas is smaller as compared to carrier antennas. However, since an antenna pattern is formed on a main circuit board, space utilization of the main circuit board is restricted.

SUMMARY OF THE INVENTION

An aspect of the present invention is to address at least the above-mentioned problems and/or disadvantages and to provide at least the advantages described below. Accordingly, an aspect of the present invention is to provide a TSP antenna of a mobile terminal capable of increasing internal space utilization of the mobile terminal while the antenna is provided in the mobile terminal.

In accordance with an aspect of the present invention, a Touch Screen Panel (TSP) antenna of a mobile terminal is provided. The TSP antenna includes an indium tin oxide (ITO) film stacked in a TSP, an upper electrode line, a lower electrode line, a left electrode line, and a right electrode line formed at an upper or lower surface of the ITO film, an external surface including an upper surface formed between an upper end of an electrode line formation surface of the ITO film and the upper electrode line, a lower surface formed between a lower end of the electrode line formation surface of the ITO film and the lower electrode line, a left surface formed between a left end of the electrode line formation surface of the ITO film and the left electrode line, and a right surface formed between a right end of the electrode line formation surface of the ITO film and the right electrode line, and an antenna pattern formed in at least one of the upper surface, the lower surface, the left surface, and the right surface of the external surface.

In accordance with another aspect of the present invention, a TSP is provided. The TSP includes a display unit, a transparent substrate arranged above the display unit for supporting and protecting the display unit, first and second indium tin oxide (ITO) films arranged above the transparent substrate and having spacers arranged between the first and second ITO films, an icon sheet arranged above the second ITO film for protecting the TSP, an upper electrode line, a lower electrode line, a left electrode line, and a right electrode line formed at an electrode line formation surface, an external surface including an upper surface formed between an upper end of the electrode line formation surface and the upper electrode line, a lower surface formed between a lower end of the electrode line formation surface and the lower electrode line, a left surface formed between a left end of the electrode line formation surface of the ITO film, and a right surface formed between a right end of the electrode line formation surface and the right electrode line, and an antenna pattern formed in at least one of the upper surface, the lower surface, the left surface, and the right surface of the external surface, wherein the electrode line formation surface is an upper surface of the first ITO film or a lower surface of the second ITO film.

In accordance with an aspect of the present invention, since an antenna pattern is formed at an outer surface of an ITO film stacked in a TSP, a TSP antenna can increase internal space utilization of a mobile terminal although the antenna is formed in the mobile terminal.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding, but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
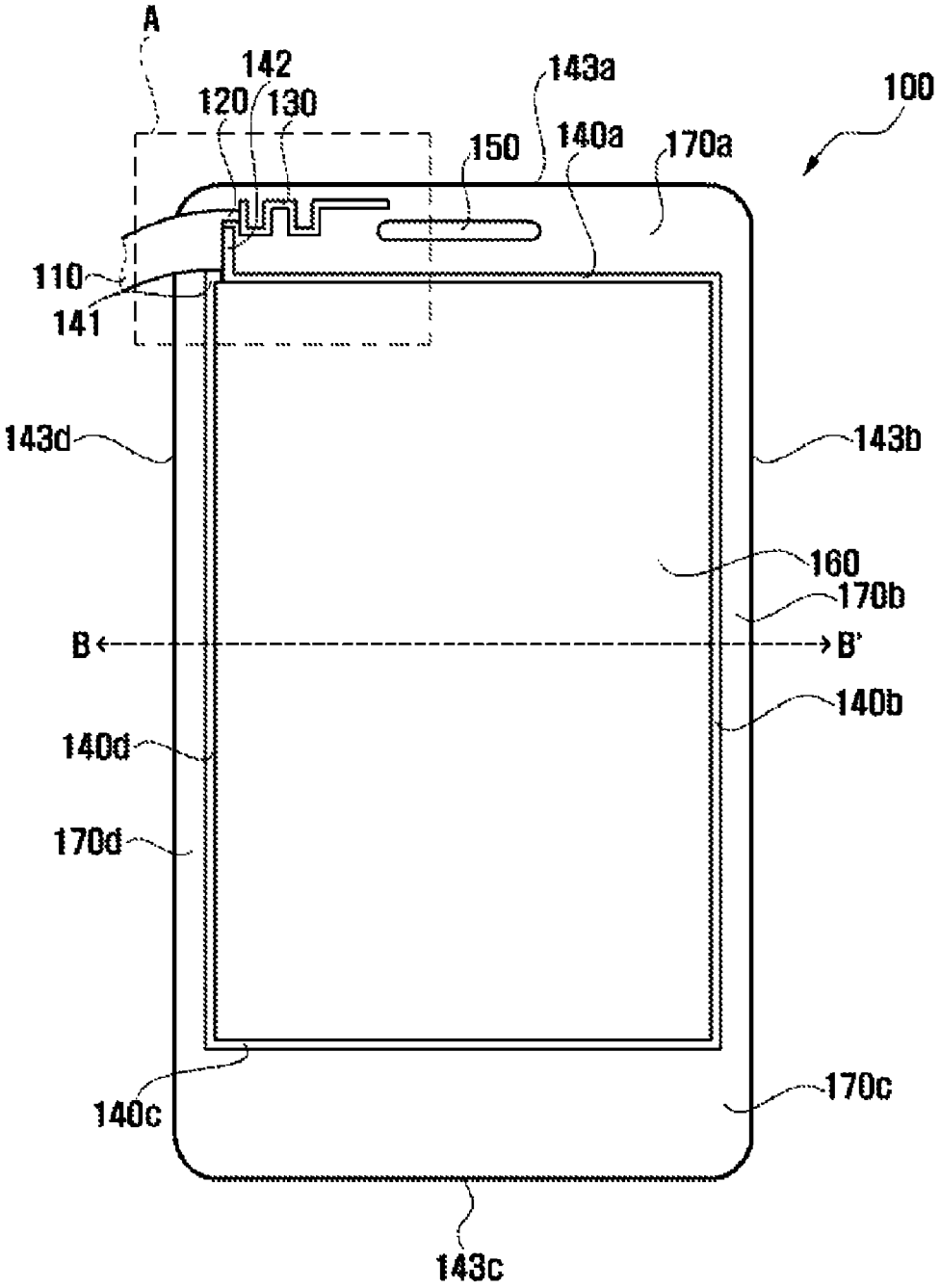
FIG. 1 is a plan view illustrating a TSP antenna of a mobile terminal according to an exemplary embodiment of the present invention.
Figure 2:
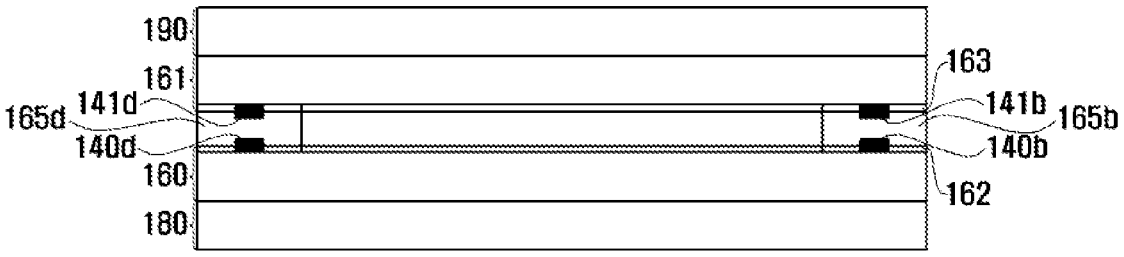
FIG. 2 is a cross sectional view taken along dotted line B-B' of FIG. 1 according to an exemplary embodiment of the present invention.
Figure 3:
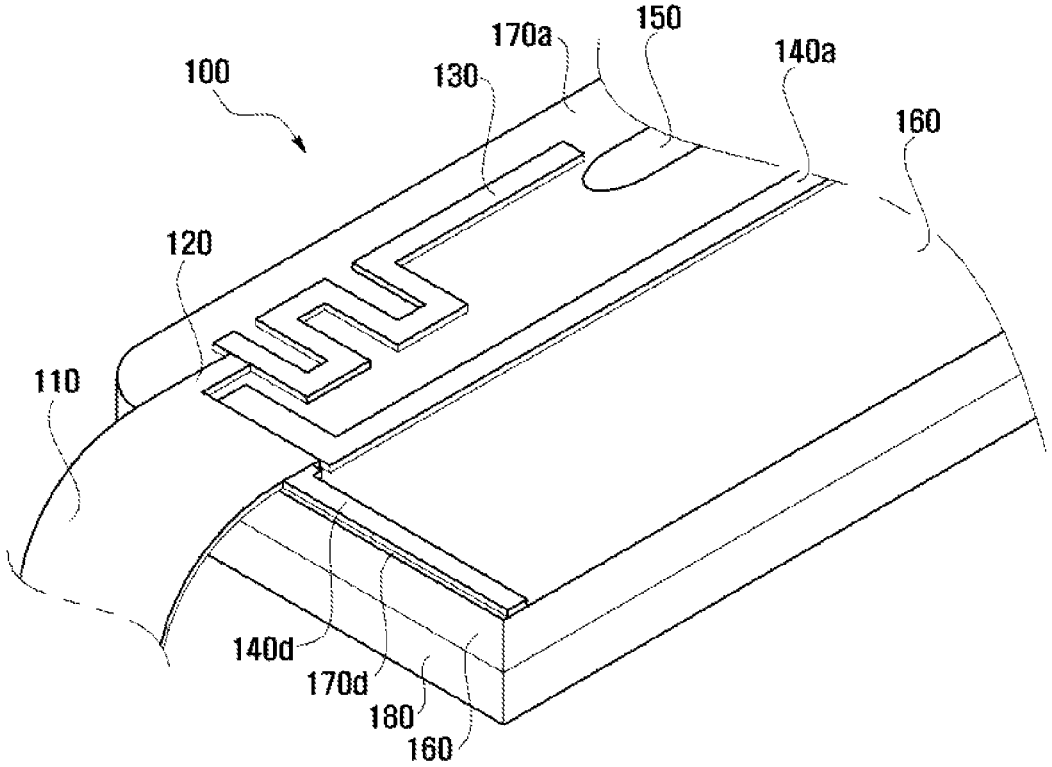
FIG. 3 is an enlarged perspective view illustrating a part A of FIG. 1 according to an exemplary embodiment of the present invention.

FIG. 1 is a plan view illustrating a TSP antenna of a mobile terminal according to an exemplary embodiment of the present invention. FIG. 2 is a cross sectional view taken along dotted line B-B' of FIG. 1. FIG. 3 is an enlarged perspective view illustrating a part A of FIG. 1.

Referring to FIG. 2, a stack structure of a TSP to which a TSP antenna of a mobile terminal is applied is as follows. A transparent substrate 180 is provided at a lowermost layer of the TSP. The transparent substrate 180 supports the TSP and protects a display device (not shown), such as a liquid crystal display (LCD), provided at a lower portion thereof. The transparent substrate 180 may be composed of reinforced glass or polycarbonate (PC). A first ITO film 160 is stacked on an upper surface of the transparent substrate 180, spacers 165*b* and 165*d* are stacked on an upper surface of the ITO film 160, and a second ITO film 161 is stacked on the spacers 165*b* and 165*d*. The first ITO film 160 and the second ITO film 161 serve as a thin film of a transparent circuit. The first ITO film 160 and the second ITO film 161 may be composed of polyethylene terephthalate (PET), in which ITO coating layers 162 and 163 are respectively formed at an upper surface and a lower surface thereof. An icon sheet 190 is stacked at an upper surface of the second ITO film 161, and protects the TSP. An icon may be printed on the icon sheet 190. The icon sheet 190 may also be composed of PET.

The TSP shown in FIG. 2 is a resistive overlay TSP. The first ITO film 160 and the second ITO film 161 function as a first resistive film and a second resistive film, respectively. Electrode lines 140*b* and 140*d* are formed at an ITO coating layer 162 of the first ITO film 160, and electrode lines 141*b* and 141*d* are formed at an ITO coating layer 163 of the second ITO film 161. The electrode lines 140*b*, 140*d*, 141*b*, and 141*d* may be formed of silver.

Referring to FIG. 1 to FIG. 3, the following is a description of a TSP antenna of a mobile terminal 100 according to a first embodiment of the present invention.

As shown in FIG. 1, an upper electrode line 140*a*, a lower electrode line 140*c*, a left electrode line 140*d*, and a right electrode line 140*b* are formed at an upper surface of the first ITO film 160. External surfaces 170*a*, 170*b*, 170*c*, and 170*d* are formed around edges of an electrode line formation surface of the first ITO film 160. The external surfaces 170*a*, 170*b*, 170*c*, and 170*d* are composed of an upper surface 170*a*, a lower surface 170*c*, a left surface 170*d*, and a right surface 170*b*. The upper surface 170*a* is formed between an upper end 143*a* of an electrode line formation surface of the first ITO film 160 and the upper electrode line 140*a*. The lower surface 170*c* is formed between a lower end 143*c* of the electrode line formation surface of the first ITO film 160 and the lower electrode line 140*c*. The left surface 170*d* is formed between a left end 143*d* of the electrode line formation surface of the first ITO film 160 and the left electrode line 140*d*. The right surface 170*b* is formed between a right end 143*b* of the electrode line formation surface of the first ITO film 160 and the right electrode line 140*b*.

A Flexible Printed Circuit Board (FPCB) 110 shown in FIG. 1 is formed around a left end of the upper surface 170*a* to be connected with an end 142 of the upper electrode line 140*a* and an upper end 141 of the left electrode line 140*d*. The FPCB 110 may be formed around a right end of the upper surface 170*a* to be connected with an end of the upper electrode line 140*a* and an upper end of the right electrode line 140*b*. The FPCB 110 may be formed around a left end of the lower surface 170*c* to be connected with an end of the lower electrode line 140*c* and a lower end of the left electrode line 140*d*. The FPCB 110 may be formed around a right end of the lower surface 170*c* to be connected with an end of the lower electrode line 140*c* and a lower end of the left electrode line 140*d*.

An antenna pattern 130 is formed at the upper surface 170*a* as shown in FIG. 1. The antenna pattern 130 may be formed of silver as in the electrode lines 140*a*, 140*b*, 140*c*, and 140*d*. One end of the antenna pattern 130 connects with a power feeding unit 120 of the FPCB that is formed around a left end of the upper surface 170*a*. The antenna pattern 130 shown in FIG. 1 has a meander line shape.

Figure 4:
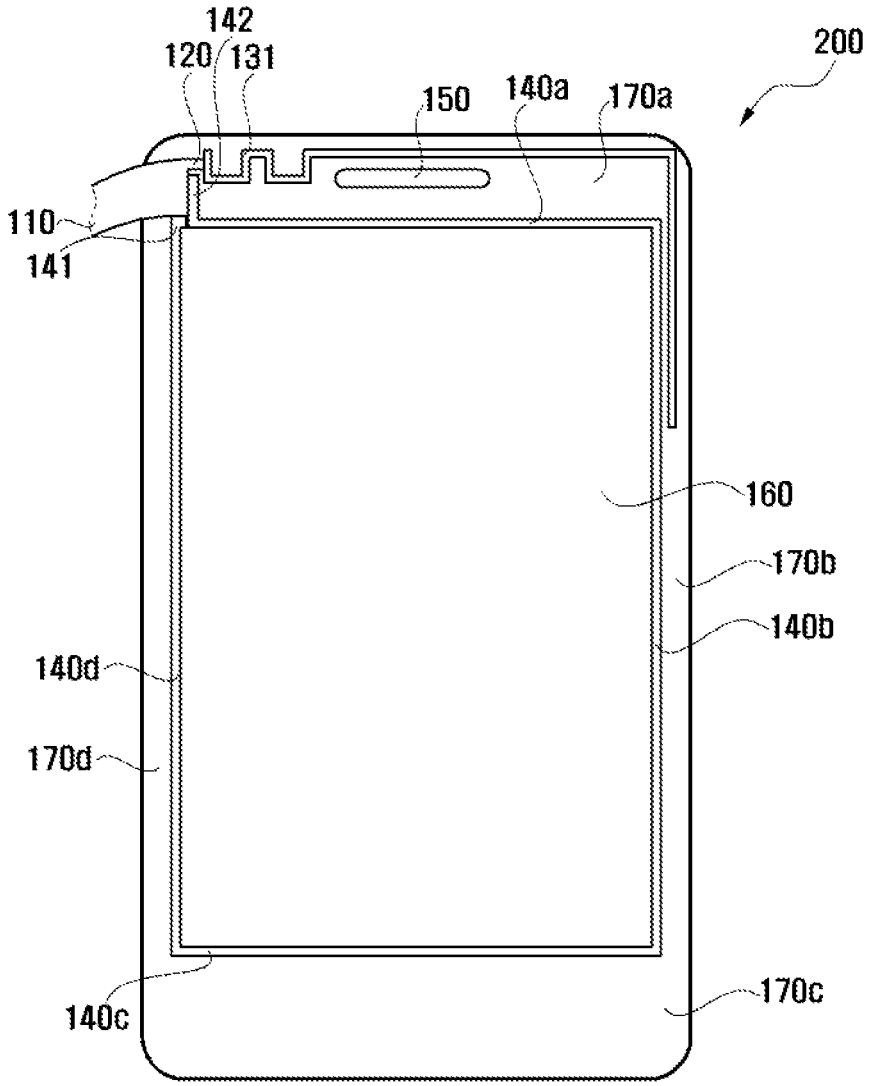
FIG. 4 is a plan view illustrating a TSP antenna of a mobile terminal according to an exemplary embodiment of the present invention.

FIG. 4 is a plan view illustrating a TSP antenna of a mobile terminal according to an exemplary embodiment of the present invention.

Referring to FIG. 4, unlike the antenna pattern 130 shown in FIG. 1, an antenna pattern 131 of a TSP antenna 200 shown in FIG. 4 extends from the upper surface 170*a* to the right surface 170*b*. Since an antenna pattern of the second embodiment has a length longer than that of the antenna pattern 130 of the first embodiment, the antenna pattern 131 can be used in a frequency band lower than that of the antenna pattern 130. Remaining configurations are the same as those of the first embodiment, except for the foregoing configuration of the second embodiment.

As shown in FIGS. 1-4, the antenna patterns 130 and 131 are formed at the lower surface 170*a* or the right surface 170*b*. However, according to an exemplary embodiment of the present invention, an antenna pattern may also be formed in at least one of the upper surface 170*a*, the lower surface 170*c*, the left surface 170*d*, or the right surface 170*b*. Since antenna patterns 130 and 131 are formed at an external surface of an upper surface of the first ITO film 160 and an ITO coating layer 163 is formed at a lower surface of the second ITO film 161, the antenna pattern may be formed at an external surface of a lower surface of the second ITO film 161 instead of an upper surface of the first ITO film 160.

The TSP antenna of a mobile terminal according to an exemplary embodiment of the present invention is applicable to all antennas such as antenna having a frequency band greater than 1.56 GHz, such as Bluetooth (BT), Global Positioning System (GPS), and WiFi; a main antenna, such as Global System for Mobile communications (GSM), Code Division Multiple Access (CDMA), and Wideband CDMA (WCDMA); and a diversity antenna. When a data transmission speed becomes 14.4 Mbps as in 3.5G High Speed Downlink Packet Access (HSDPA), a base station should increase download power to a terminal to reduce fading. However, when the TSP antenna of a mobile terminal according to an exemplary embodiment of the present invention is used as a diversity antenna, the TSP antenna can reduce the burden of the base station.

The antenna patterns 130 and 131 are applied to the resistive overlay TSP. Because a conductive pattern of an ITO film is provided in a capacitive TSP, an exemplary embodiment of the present invention is also applicable to the capacitive TSP. If the TSP is provided, an exemplary embodiment of the present invention may be employed in a slider or folder type mobile terminal.

Figure 5:
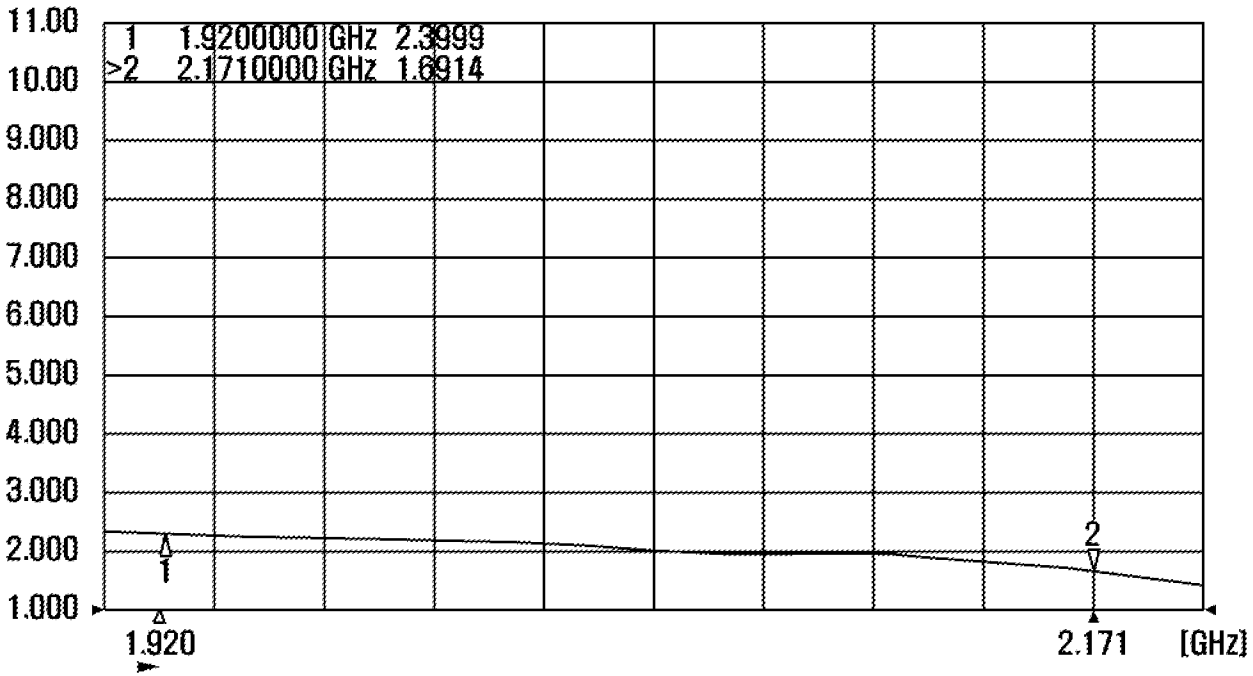
FIG. 5 is a graph illustrating a Voltage Standing Wave Ratio (VSWR) in a TSP antenna of a mobile terminal according to an exemplary embodiment of the present invention.
Figure 6:
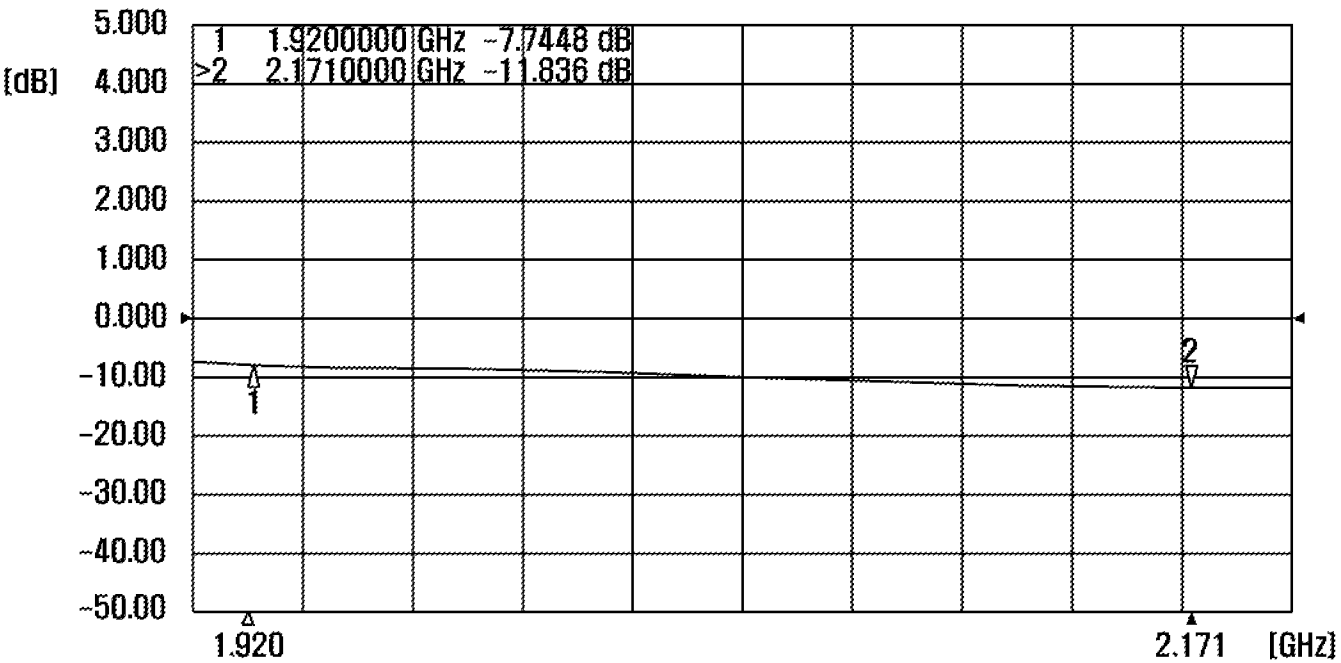
FIG. 6 is a graph illustrating a return loss in a TSP antenna of a mobile terminal according to an exemplary embodiment of the present invention.

FIG. 5 is a graph illustrating a voltage standing wave ratio (VSWR) in a TSP antenna of a mobile terminal according to an exemplary embodiment of the present invention. FIG. 6 is a graph illustrating a return loss in a TSP antenna of a mobile terminal according to an exemplary embodiment of the present invention.

Referring to FIGS. 5 and 6, a transverse axis and a vertical axis of FIG. 5 represent frequency and VSWR, respectively, and a transverse axis and a vertical axis of FIG. 6 represent frequency and return loss, respectively. The TSP antenna pattern 130 has an excellent performance in that VSWR and return loss range 2.3999~1.6914 and −7.7448 ~−11.836 dB at 1.920~2.171 GHz being WCDMA2100 band, respectively.

In the TSP antenna according to an exemplary embodiment of the present invention, since antenna patterns 130 and 131 are formed on at least one of the upper surface 170*a*, the lower surface 170*c*, the left surface 170*d*, and the right surface 170*b* of an external surface of an ITO film 160 stacked in a TSP, the TSP antenna can increase space utilization larger than that of a conventional internal antenna of a mobile terminal. As illustrated in FIG. 5 and FIG. 6, an exemplary embodiment of the present invention has an excellent performance in VSWR and return loss.

While the invention has been described with reference to certain exemplary embodiments thereof, it will be understood by those skilled in the art that various changes in form and details may be made therein without departing from the spirit and scope of the invention as defined in the appended claims and their equivalents.

What is claimed is:

1. A Touch Screen Panel (TSP) antenna of a mobile terminal, the TSP antenna comprising:

an indium tin oxide (ITO) film stacked in a TSP, wherein the ITO film includes:

an electrode line formation surface formed at an upper and a lower surface of the ITO film, the electrode line formation surface comprising at least one electrode line configured to be away from a predetermined distance toward an inner direction from a periphery edge of the ITO film, an external surface formed between the at least one electrode line and the edges of the electrode line formation surface, and an antenna pattern formed along an edge of the external surface, and wherein a Flexible Printed Circuit Board (FPCB) is connected to an end and a other end of the electrode lines and an end of the antenna pattern is connected to a power feeding unit of the FPCB.

2. The TSP antenna of claim 1, wherein the antenna pattern has a meander line shape.

3. The TSP antenna of claim 1, wherein the FPCB is formed around a left end of the upper surface of the ITO film.

4. The TSP antenna of claim 1, wherein the FPCB is formed around a right end of the upper surface of the ITO film.

5. The TSP antenna of claim 1, wherein the FPCB is formed around a left end of the lower surface of the ITO film.

6. The TSP antenna of claim 1, wherein the FPCB is formed around a right end of the lower surface of the ITO film.

7. The TSP antenna of claim 1, wherein the TSP antenna is one of a Bluetooth antenna, a Global Positioning System (GPS) antenna, or a Wi-Fi antenna.

8. The TSP antenna of claim 1, wherein the TSP antenna is a main antenna.

9. The TSP antenna of claim 1, wherein the TSP antenna is a diversity antenna.

10. A touch screen panel (TSP) comprising:

a display unit;

a transparent substrate arranged above the display unit for supporting and protecting the display unit;

first and second indium tin oxide (ITO) films arranged above the transparent substrate and having spacers arranged between the first and second ITO films;

an icon sheet arranged above the second ITO film for protecting the TSP, wherein each of the ITO films includes:

an electrode line formation surface formed at an upper and a lower surface of each of the ITP films, the electrode line formation surface comprising at least one electrode lines configured to be away from a predetermined distance toward an inner direction from a periphery edge of the ITO film, an external surface formed between the at least one electrode line and the edges of the electrode line formation surface, and an antenna pattern formed along an edge of the external surface, wherein a Flexible Printed Circuit Board (FPCB) is connected to an end and a other end of the electrode lines and an of the antenna pattern is connected t a power feeding unit of the FPCB.

11. A mobile terminal comprising the TSP of claim 10.

* * * * *